United States Patent [19]

Spolnicki

[11] 4,115,989

[45] Sep. 26, 1978

[54] PRODUCT AND PROCESS

[75] Inventor: Jerzy Spolnicki, Camden, S.C.

[73] Assignee: E. I. Du Pont de Nemours and Company, Wilmington, Del.

[21] Appl. No.: 792,708

[22] Filed: May 2, 1977

[51] Int. Cl.[2] ..... D02G 1/16; D02G 3/04

[52] U.S. Cl. ..... 57/140 BY; 57/157 F; 428/374

[58] Field of Search ..... 57/140 BY, 157 F; 428/373–374

[56] References Cited

U.S. PATENT DOCUMENTS

| | | | |
|---|---|---|---|
| 3,454,460 | 7/1969 | Bosley | 428/374 |
| 3,462,938 | 8/1969 | Melita | 57/157 |
| 3,558,760 | 1/1971 | Olson | 28/271 |
| 3,785,135 | 1/1974 | Seem et al. | 57/157 TS X |
| 3,800,374 | 4/1974 | Ozawa et al. | 28/267 |
| 3,854,177 | 12/1974 | Breen et al. | 28/254 |
| 3,861,133 | 1/1975 | Frankfort et al. | 57/157 F X |

FOREIGN PATENT DOCUMENTS 22,896 6/1971 Japan.

*Primary Examiner*—Charles Gorenstein

[57] ABSTRACT

Polyester yarn having the desirable crimp properties of false-twist textured, heat-set yarn is produced from melt-spun and drawn bicomponent filaments wherein poly(ethylene terephthalate) of 12 to 15 relative viscosity is one component and a copolyester of 23 to 26 relative viscosity, preferably poly(ethylene/2,2-dimethyl-1,3-propylene terephthalate) containing about 90 mole percent ethylene terephthalate units, is the other component. The bicomponent filaments are annealed at constant length to crystallize the polyethylene terephthalate component, forwarded in a jetted stream of heated compressible fluid, impinged in a plasticized condition against a moving screen, cooled and then taken up from the screen. The process can be operated continuously at high speeds, e.g., windup speeds of 3,000 to 4,000 meters per minute.

6 Claims, 3 Drawing Figures

PRODUCT AND PROCESS

BACKGROUND OF THE INVENTION

This invention relates to jet-textured multifilament yarn of side-by-side bicomponent filaments, and is more particularly concerned with providing textured polyester yarn which has yarn bulk and filament crimp aesthetics characteristic of monocomponent set-textured polyester yarn produced by false-twist texturing, and has advantages thereover of freedom from torque, less glitter and enhanced dyeability.

Continuous-filament polyester yarns of monocomponent filaments which have been false-twist textured and then heat set to remove a substantial amount of torque constitute the great majority of yarns used for knitted or woven apparel fabric where bulk, cover and warmth are desired along with the wrinkle resistance and other desirable properties characteristic of polyester yarns. False-twist texturing is accomplished by introducing twist in yarn as it passes over a heater, cooling the twisted yarn and then untwisting the yarn. Seem et al. U.S. Pat. No. 3,785,135 is concerned with the problem created by torque set in the yarn by false-twist texturing, and discloses methods of reducing the amount of torque without removing too much of the crimp set in the filaments. The untwisted yarn can be reheated under carefully controlled conditions of temperature and tension, either in package form or during passage over a second heater. Residual torque can be further reduced by reverse twisting the yarn during the second heating. The combination of treatments requires considerable time and uniform textured yarn is difficult to produce.

Bosley U.S. Pat. No. 3,454,460 discloses production of side-by-side bicomponent polyester fibers for use in staple-spun yarn. Examples I and III illustrate melt-spinning either poly(ethylene terephthalate/isophthalate) or poly(ethylene/2,2-dimethyl-1,3-propylene terephthalate) as one component and poly(ethylene terephthalate) as the other component of the bicomponent fiber. Crimp is developed in the fibers by heating to a temperature of approximately 100° C. or reasonably above, preferably after being woven into fabric. Example II illustrates staple-spinning the fibers into yarn, weaving the yarn into fabric, and developing the crimp when the fabric is scoured and bleached at the boil. The crimp obtained is adequate for conventional uses of staple-spun yarn, but is quite inadequate for the uses of false-twist textured, heat set, polyester yarn of continuous filaments.

SUMMARY OF THE INVENTION

The present invention provides polyester yarn of bicomponent filaments, which has high bulk and filament crimp characteristic of monocomponent set-textured polyester yarn and is free from torque. The filament cross section is substantially uniform along the length of each filament, which avoids objectionable glitter of set-textured yarns caused by the distorted filament cross sections which result from false-twist texturing processes. The invention provides an economical process for preparing the novel yarn which is capable of being conducted as a continuous high-speed operation and which imparts enhanced dyeability.

The crimped yarn of this invention is a multifilament yarn of bicomponent filaments composed of a poly(ethylene terephthalate) component and a copolyester component intimately adhered together in side-by-side relationship along the length of each filament, the poly(ethylene terephthalate) component having a relative viscosity of 12 to 15 as determined for a solution of 0.8 gram of polymer in 10 milliliters of hexafluoropropanol at 25° C., and the copolyester component having a relative viscosity value of 23 to 26 that is 11 to 14 units higher than the relative viscosity of the poly(ethylene terephthalate) component. The copolyester component consists of about 90 mole percent of ethylene terephthalate and about 10 mole percent of other ester units that form a copolyester which has a Tg shrinkage value of 49° to 65° C., e.g., poly(ethylene/2,2-dimethyl-1,3-propylene terephthalate) or poly(ethylene terephthalate/isophthalate) of about 9/1 mole ratio. The filaments are characterized by a substantially uniform cross section along the length of each filament, by a random helical crimp along each filament which is random relative to the crimp of adjacent filaments, and by a crimp frequency of 25 to 40 crimps per inch (10–17 crimps/cm) of filament length with at least 50 percent of the crimps having a helix diameter of at least 1.7 mils (43 microns). The yarn has a crimp contraction value of 5 to 9 percent when tested as defined subsequently.

The process for producing the yarn of this invention comprises simultaneously melt-spinning poly(ethylene terephthalate) and a copolyester in side-by-side relationship to form bicomponent filaments wherein the poly(ethylene terephthalate) component has a relative viscosity of 12 to 15 and the copolyester component has a relative viscosity value of 23 to 26 that is 11 to 14 units higher than the relative viscosity of the poly(ethylene terephthalate) component, uniformly drawing the filaments at about 3.4 to 4.0X draw ratio to orient the copolyester component, annealing the drawn filaments at 150° to 180° C. and substantially constant length to crystallize the poly(ethylene terephthalate) component, feeding the annealed filaments directly into a jetted stream of compressible fluid at a temperature which plasticizes the filaments without causing fusion between filaments, impinging the filaments in the turbulent stream of fluid onto a moving surface to separate the filaments from the jetted fluid, the temperature of the jetted fluid being adjusted to provide a filament overfeed of about 10 to 18 percent through the jetted stream, and conveying the filaments on the moving surface for cooling in a substantially tensionless state prior to windup. The process is preferably a continuous high-speed operation with the filaments being wound up as yarn at 3,000 to 4,000 meters per minute.

The copolyester component is preferably poly(ethylene/2,2-dimethyl-1,3-propylene terephthalate) having an ethylene/dimethyl-propylene mole ratio of about 9/1. Good results are also obtained with poly(ethylene terephthalate/isophthalate) containing about 90 mole percent of ethylene terephthalate units.

DETAILED DISCLOSURE

Figure 1:
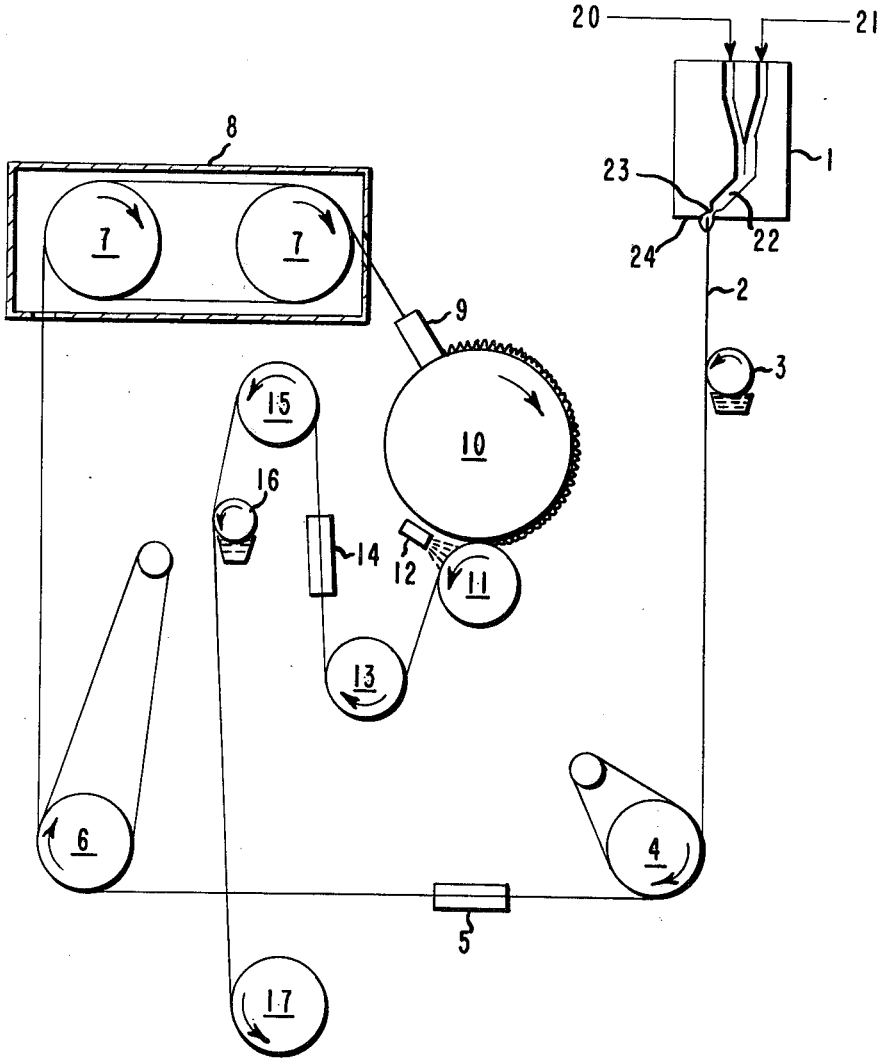
FIG. 1 is a schematic representation of an embodiment of the process and apparatus used therein.

The multifilament yarn of this invention is composed of side-by-side bicomponent filaments, usually 34 or more filaments. For simplicity, only one filament is shown in the preferred process for producing it illustrated in FIG. 1. Poly(ethylene terephthalate) and a copolyester thereof, preferably poly(ethylene/2,2-dimethyl-1,3-propylene terephthalate), are melt spun in side-by-side relationship from a plurality of orificies of spinneret 1 to form filaments 2 which are cooled by a cross flow quench system (not shown) and gathered into a yarn. Finish is applied to the yarn by primary finish roll 3. The yarn then passes around feed rolls 4, through a steam draw jet 5, and around draw rolls 6 which rotate at higher surface speed to draw the yarn at about 3.4 to 4.0X draw ratio. A slight amount of draw is applied by second stage draw rolls 7 located in hot chest 8, where the yarn is heated during a residence time of at least 0.136 second to anneal the yarn at substantially constant length at 150° to 180° C. The drawn and annealed yarn passes directly into a hot jetted stream of turbulent steam or hot air in bulking jet device 9, which permanently crimps the yarn filaments and deposits them on a rotating screen drum 10 revolving at much slower linear speed than the filaments to form a "caterpillar". The yarn relaxes and cools in a substantially tensionless state prior to removal over a smaller wheel 11, and water is sprayed on the "caterpillar" by nozzle 12 (wheel 11 and nozzle 12 are optional). The "caterpillar" is unravelled by tension applied by puller roll 13. The temperature of the steam or air jetted in bulking jet device 9 is adjusted to provide a filament overfeed of about 10 to 18 percent through the jet. The yarn filaments are interlaced by interlace jet device 14, pass around letdown roll 15 and the yarn is packaged at windup 17. The winding tension is adjusted by setting the relative speeds of the windup and the letdown roll. Finish roll 16 applies knitting oil to the yarn prior to windup.

The desired properties are obtained in the product by (a) melt-spinning bicomponent filaments having components of suitable composition, (b) drawing the filaments at a draw ratio which will provide a marked difference of orientation in the two filament components, (c) annealing the filaments to crystallize the less oriented component while maintaining the orientation of the more highly oriented component, and (d) crimping the filaments at the proper overfeed through the bulking jet.

One component is poly(ethylene terephthalate) of 12 to 15 relative viscosity. The other component is a copolyester which is similar in containing about 90 mole percent of ethylene terephthalte units, but which differs in containing ester units that will retard crystallization and in having a relative viscosity value of 23 to 26 that is 11–14 units higher than the relative viscosity of the poly(ethylene terephthalate) component. The ester units used to retard crystallization should provide a copolyester having a Tg shrinkage value substantially the same as that of the poly(ethylene terephthalate) component, i.e., the Tg shrinkage value should be 49° to 65° C. Preferably the copolyester component is poly(ethylene/2,2-dimethyl-1,3-propylene terephthalate) having an ethylene/dimethylpropylene mole ratio of about 9/1. Another suitable copolyester composition is poly(ethylene terephthalate/isophthalate) having a terephthalate/isophthalate mole ratio of about 9/1.

Melt spinning of the two components to form a bicomponent filament requires a special spinneret of the type indicated in FIG. 1. The poly(ethylene terephthalate) component has a much lower melt viscosity than the copolyester component and pushes it aside on leaving the spinneret orifice, so that the center line of the extruded filament is deflected at an angle to the center line of the spinneret orifice. The angle of deflection is large enough to cause serious difficulty when attempting to spin from an orifice drilled perpendicular to the spinneret face. In the spinneret 1 of FIG. 1, molten poly(ethylene terephthalate) is forced through passage 20 and molten copolyester is forced through passage 21. The two polymers come together in passage 22 and proceed in side-by-side relation, without mixing, to spinneret orifice 23. The center lines of passage 22 and orifice 23 are inclined at an angle of about 45° to the spinneret face 24 to substantially compensate for the deflection caused by the difference in melt viscosities of the polymer.

The as-spun bicomponent filaments are drawn to orient the copolyester component under conditions which will provide a marked difference of orientation in the two components. If the draw ratio is too low there will not be enough orientation in the copolyester component to provide high shrinkage. If the draw ratio is too great, the break elongation of the filaments will be too low and the desired crimp will not be obtained. For conventional spinning speeds, a draw ratio of about 3.4 to 4.0X is suitable for producing products having crimp and break elongation comparable to those of commercial false-twist textured, heat set yarns.

The filaments are annealed at 150° to 180° C. to crystallize the poly(ethylene terephthalate) component and at substantially constant length to maintain the orientation of the copolyester component. The crystallization reduces shrinkage of the poly(ethylene terephthalate). The copolyester component is much more difficult to crystallize, and the higher relative viscosity further retards crystallization, so that high shrinkage is retained in the copolyester component.

The filaments are crimped at an overfeed of about 10 to 18 percent through the bulking jet. Percent overfeed is defined as:

100 (draw roll speed - windup speed)/windup speed.

It has been determined empirically that the crimp frequency introduced in the filaments, in crimps per inch (per 2.54 cm) of filament length is equal to 17.9 + 1.05P, where P is the percent overfeed through the bulking jet. Accordingly, an overfeed of 10 to 18 percent will provide a crimp frequency of about 27 to 37 crimps per inch of filament length, which corresponds to typical commercial false-twist textured, heat set yarns of 160 denier and 34 filaments.

An overfeed of 10 to 18 percent is much lower than is normally used for a bulking jet. The lower overfeed provides higher productivity from the process. Also the yarns produced have higher yield points and, therefore, resist stretching in fabric processing to produce "shiners" (portions with visible crimp loss). High overfeed must be avoided in the process of this invention because it gives excessively high crimp frequency, low tenacity, low yield point, low abrasion resistance, and low modulus.

The crimped yarn of this invention is a multifilament yarn, preferably of about 160 denier and 34 filaments.

The yarn is composed of bicomponent filaments, each filament having a uniform cross section along the length of the filament. The two components are intimately adhered together in side-by-side relationship along the length of each filament. One component is poly(ethylene terephthalate) of 12 to 15 relative viscosity as determined for a solution of 0.8 gram of polymer in 10 milliliters of hexafluoropropanol at 25° C. The other component is a copolyester having a relative viscosity value in the range of 23 to 26 that is 11 to 14 units higher than the relative viscosity of the poly(ethylene terephthalate) component. The copolyester consists of about 90 mole percent ethylene terephthalate units and about 10 mole percent of crystallization-retarding units which form a copolyester having a Tg shrinkage value of 49° to 65° C. Poly(ethylene/2,2-dimethyl-1,3-propylene terephthalate) and poly(ethylene terephthalate/isophthalate) have Tg shrinkage values about the same as that of poly(ethylene terephthalate) and are preferred, but the copolyester component may consist of other combinations of glycol terephthalates which provide equivalent properties in the yarn.

The filaments have a random helical crimp along each filament which is random relative to the crimp of adjacent filaments. The crimp frequency is 25 to 40 crimps per inch (10–17 crimps/cm) of filament length (length filament has when fully extended), with at least 50 percent of the crimp having a helix diameter of at least 1.7 mils (43 microns). The yarn has a crimp contraction value of 5 to 9 percent under a load of 5 mg./denier. A typical commercial 160 denier, 34 filament, false-twist-textured and heat set yarn has a crimp frequency of 30 to 35 crimps per inch (12–14 crimps/cm) with about 50 percent of the crimps having a helix diameter of at least 1.7 mils (43 microns), and has a crimp contraction value of 6 to 8 percent. However, false-twist texturing distorts filament cross sections to an extent which causes objectionable glitter in fabrics, whereas the present invention provides filament cross sections which are substantially uniform along the length of each filament. Moreover, the yarn of this invention is free from torque.

The filaments of the present invention are crimped while they are separated and whipped about in a hot jetted stream of turbulent steam or hot air which develops a distinctive randomness in the dimensions of the helical crimps produced. There is little in-phase character in the crimp, so the filaments do not pack together in the yarn. The bulk imparted to the yarn is superior to that obtained when bicomponent filaments are crimped in a non-turbulent system, such as a hot water bath, which imparts considerable follow-the-leader crimp. Bulk is reduced by follow-the-leader crimp.

EXAMPLE

Proceeding as disclosed in connection with FIG. 1, poly(ethylene terephthalate) of 15 relative viscosity and poly(ethylene/2,2-dimethyl-1,3-propylene terephthalate) (90/10 mole ratio) of 26 relative viscosity are extruded from 34 spinneret orifices, each of the type shown in FIG. 1, to form side-by-side bicomponent filaments which are cooled and converged into yarn. The yarn is drawn at about 3.4X draw ratio, annealed at 160° C. in hot chest 8, crimped at 13 percent overfeed with bulking jet 9, cooled on bulking drum 10, interlaced with interlace jet 14 and wound as a package at windup 17. The processing conditions are given in the table. The bulking jet used is disclosed in Coon U.S. Pat. No. 3,525,134. The jet device has a yarn passage diameter of 0.033 inch (0.84 mm), a throat region diameter of 0.045 inch (1.15 mm) and a conical treatment chamber on a common center line with the yarn passage. The sides of the treatment chamber diverge outward, at an angle of 4.5 to the common center line, from the throat to an exit diameter of 0.22 inch (5.6 mm). Steam is introduced into the throat by two fluid conduits, one on each side. Each conduit diameter is 0.025 inch (0.64 mm) and the conduit is inclined forward at an angle 30° to the common center line of the yarn passage and treatment chamber.

The 34 filament yarn produced has a bulked denier of 152, an average of 31 helical crimps per inch (12 per cm) of filament length with 65 percent of the crimps having a helix diameter of at least 1.7 mils (43 microns) and has a crimp contraction value of 7.5 percent under 5 mg/denier load. The boil-off shrinkage of the yarn is 1.8 percent, the tenacity is 3.5 grams per denier, and the elongation at break is 36 percent.

Figure 2:
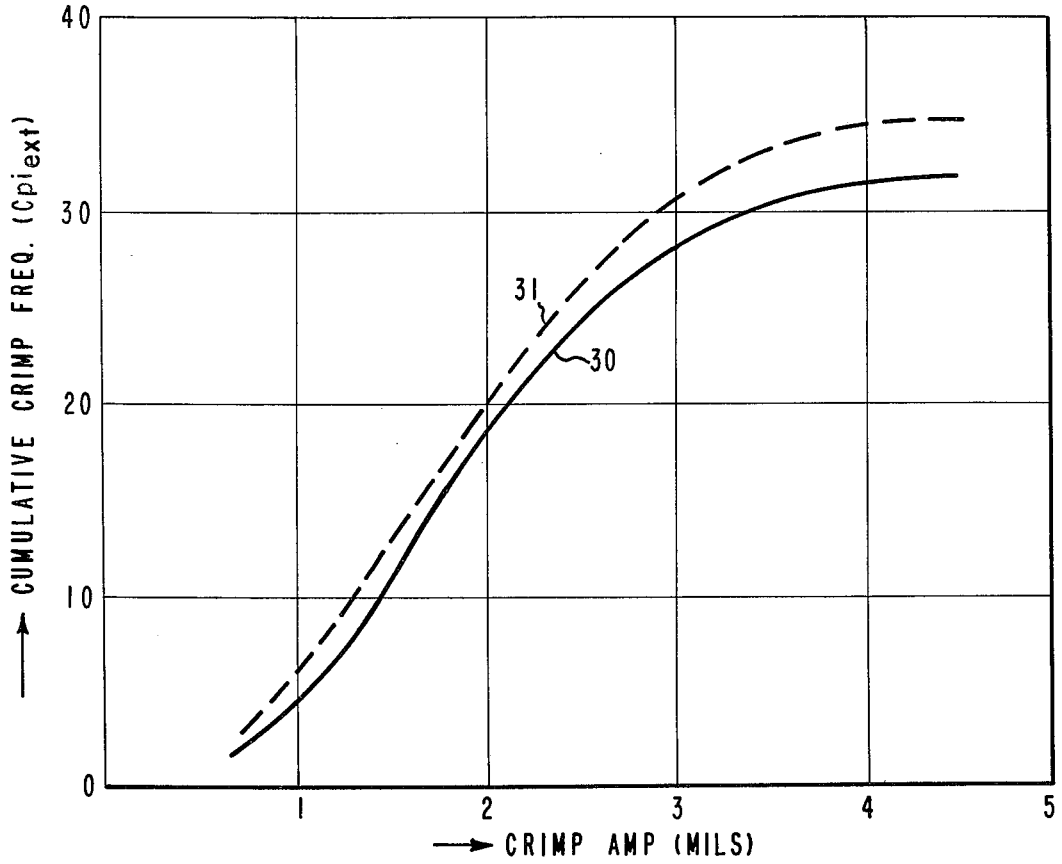
FIG. 2 is a graph of cumulative crimp frequency as a function of crimp amplitude for a yarn of this invention in comparison with a false-twist textured and heat set yarn typical of commercial "set-textured" polyester yarns.
Figure 3:
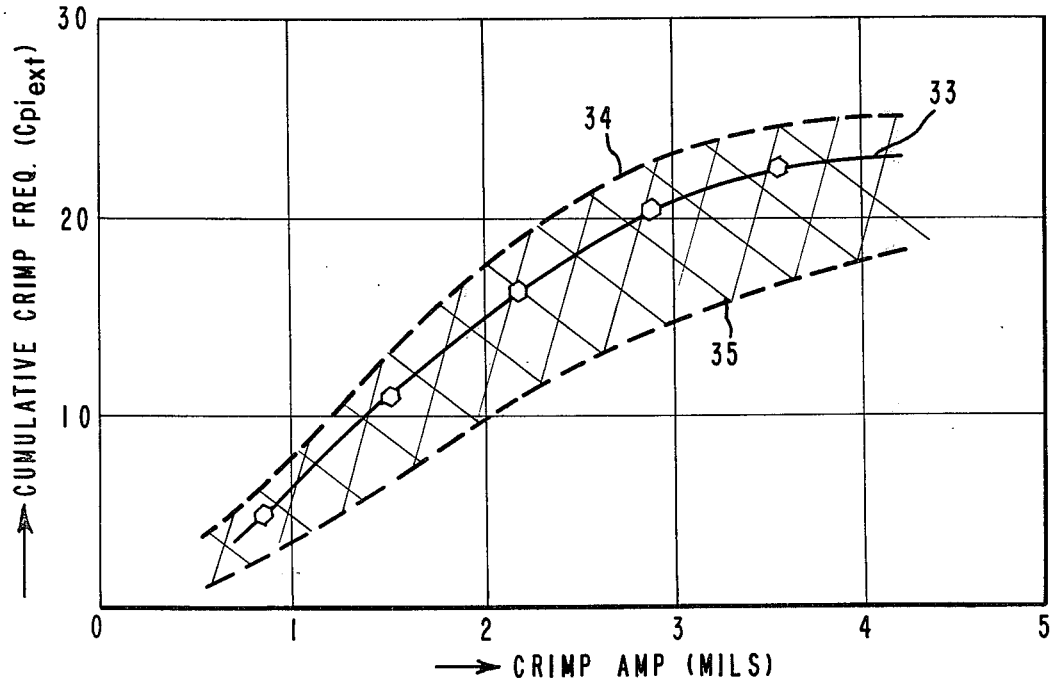
FIG. 3 is a similar graph for filaments taken from an 18 cut jet dyed Swiss Pique fabric made from yarn of the present invention, in comparison with crimp characteristics found for commercial "set-textured" polyester filaments.

The crimp in the yarn closely approximates that of commercial false-twist textured and heat set yarn as shown in FIGS. 2 and 3. The lines in FIG. 2 show cumulative crimp frequency, in crimps per inch (per 2.54 cm) of filament length, as a function of crimp amplitude in mils (25.4 microns). Line 30 for the yarn of this example closely follows line 31 for a typical false-twist, set-textured yarn. FIG. 3 is a similar plot of cumulative crimp frequency as a function of crimp amplitude for filaments taken from an 18 cut, jet-dyed, Swiss Pique fabric. Line 33 shows values obtained for yarn of this example. The area between outer lines 34 and 35 represents crimp characteristics for typical false-twist, set-textured polyester filaments which are commercially available.

TABLE

Primary Finish Roll 3 Speed: 90 RPM

Feed Roll 4 Yarn Speed: 1174 YPM (1075 meters/minute)

Draw Jet 5 Steam Pressure: 90 PSIG (6.17 atmospheres)

Draw Jet Temperature: 240° C.

First Stage Draw Roll 6 Speed: 3990 YPM (3650 m/m)

Second Stage Draw Roll 7 Speed: 4003 YPM (3680 m/m)

Number of Wraps on Second Stage Rolls: 7½

Hot Chest Temperature: 160° C.; Residence Time: 0.136 seconds

Bulking Jet Steam Pressure: 50 PSIG (3.4 atmospheres)

Bulking Jet Temperature: 215° C.

Bulking Drum 10 Speed: 235 YPM (215 m/m)

Bulking Drum Vacuum: 2 inches $H_2O$ (5 cm)

Bulking Drum Screen Mesh: 60 × 60 per inch (23.6 × 23.6 per cm)

Quench Drum 11 Speed: 235 YPM (215 m/m)

Quench Drum Vacuum: 10–12 inches $H_2O$ (25.4–30.5 cm)

Caterpillar Take-Off Point: 6 O'Clock on Bulking Screen Drum

Puller Roll 13 Speed: 3486 YPM (3190 m/m)

Letdown Roll 14 Speed: 3579 YPM (3270 m/m)

Secondary Finish Roll 16 Speed: 32 RPM

Windup 17 Speed: 3527 YPM (3220 m/m)

Pre-Letdown Tension: 15 gms.

Pre-Windup Tension: 25 gms.

Interlace Jet 14 Air Pressure: 50 PSIG (3.4 atmospheres)

TEST METHODS

Relative viscosity (HRV) is the ratio of the viscosity of a solution of 0.8 gm of the polyester dissolved at room temperature in 10 ml of hexafluoroisopropanol containing 80 ppm $H_2SO_4$ to the viscosity of the $H_2SO_4$ — containing hexafluoroisopropanol itself, both measured at 25° C. in a capillary viscosimeter and expressed in the same units.

The Tg shrinkage value is the temperature at which the rate of shrinkage of a fiber in water increases substantially as the temperature of the fiber is raised. The measurement is made on undrawn fibers to minimize the effect of crystallinity. A small amount of polymer is extruded through an orifice to form a test fiber. The general procedure for determining Tg in water is similar to previous methods for determining other thermodynamic properties, such as the technique disclosed in Pace U.S. Pat. No. 2,556,295.

The crimp contraction value is determined as follows:

A 5,000-denier skein is prepared from the yarn, the number of wraps in the skein being determined by dividing 2,500 by the yarn denier. The skein is suspended from a hook, a 25 gm weight (5 mg/denier) is attached to the bottom of the skein loop, and the skein with the weight is lowered into boiling water. The weighted skein remains in the boiling water for 15 minutes and is then removed, dried for at least 12 hours, and the length of the weighted skein is measured ($L_0$). The 25 gram weight is then replaced by a 500 gram weight (100 mg/denier). The weight is lifted and lowered 8 times to exercise the yarn for removing entanglements, and the skein length is measured again ($L_1$). Crimp concentration under 5 mg/denier load is equal to $100(L_1-L_0)/L_1$.

Crimp frequency and crimp amplitude are measured as follows:

A section more than 3 inches (76.2 mm) long is cut from a skein which has been used for measuring crimp contraction value and 9 filaments, chosen at random, are separated from the section carefully without stretching the filaments. Masking tape is used to attach the ends of each filament to a transparent glass or plastic mount under only enough tension to eliminate kinks while preserving the relaxed crimp form. A transparent cover is then placed over the filaments. Using a Shadowgraph projector at about 10 to 15× magnification, the number of crimps is counted. The number of crimps having a helix diameter of at least 1.7 mils (43 microns) is also counted. The extended filament length of the same sample is then measured under a load sufficient to straighten but not stretch the filament, e.g., a 0.6 gram weight for 2 to 6 dpf filaments. This is done by attaching one end of the filament at the top to a vertical straight-edge, permitting the filament to hang freely under the tension of the weight, taping the bottom of the filament to the straight-edge, and mesuring the filament length. The number of crimps counted divided by this length is the crimp frequency in crimps per inch (cm) of filament length.

Yarn denier is determined on yarn which is ready for knitting. The length (L) in meters is determined for a yarn sample under approximately 0.1 gpd load and the weight (W) in milligrams of the sample is determined. The denier is equal to 9 W/L.

I claim:

1. A multifilament polyester yarn of bicomponent filaments composed of a poly(ethylene terephthalate) component and a copolyester component intimately adhered together in side-by-side relationship along the length of each filament, the poly(ethylene terephthalate) component having a relative viscosity of 12 to 15 as determined for a solution of 0.8 gram of polymer in 10 milliliters of hexafluoropropanol at 25° C. and the copolyester component having a relative viscosity of 23 to 26 that is 11 to 14 units higher than the relative viscosity of the poly(ethylene terephthalate) component, the copolyester component consisting of about 90 mole percent of ethylene terephthalate and about 10 mole percent of other ester units that form a copolyester which has a Tg shrinkage value of 49° to 65° C.; the filaments having a substantially uniform cross section along the length of each filament, a random helical crimp along each filament which is random relative to the crimp of adjacent filaments, and a crimp frequency of 25 to 40 crimps per inch of filament length with at least 50 percent of the crimps having a helix diameter of at least 1.7 mils; and the yarn having a crimp contraction value of 5 to 9 percent.

2. A polyester yarn as defined in claim 1 wherein said copolyester component of the bicomponent filaments is poly(ethylene/2,2-dimethyl-1,3-propylene terephthalate).

3. A polyester yarn as defined in claim 1 wherein said copolyester component of the bicomponent filaments is poly(ethylene terephthalate/isophthalate).

4. The process of producing crimped multifilament yarn of polyester bicomponent filaments which comprises simultaneously melt-spinning poly(ethylene terephthalate) and a copolyester which contains about 90 mole percent of ethylene terephthalate units and about 10 mole percent of 2,2-dimethyl-1,3-propylene terephthalate or ethylene isophthalate units, in side-by-side relationship to form bicomponent filaments wherein the poly(ethylene terephthalate) component has a relative viscosity of 12 to 15 and the copolyester component has a relative viscosity value of 23 to 26 that is 11 to 14 units higher than the relative viscosity of the poly(ethylene terephthalate) component, uniformly drawing the filaments at about 3.4 to 4.0X draw ratio, annealing the drawn filaments at 150° to 180° C. and substantially constant length, feeding the annealed filaments directly into a jetted stream of compressible fluid at a temperature which plasticizes the filaments without causing fusion between filaments, impinging the filaments in the turbulent stream of fluid onto a moving surface to separate the filaments from the jetted fluid, the temperature of the jetted fluid being adjusted to provide a filament overfeed of about 10 to 18 percent through the jetted stream, and conveying the filaments on the moving surface for cooling in a substantially tensionless state prior to windup.

5. A process as defined in claim 4 wherein said copolyester component is poly(ethylene/2,2-dimethyl-1,3-propylene terephthalate).

6. A process as defined in claim 4 wherein the process is carried out continuously and the yarn is wound up at 3,000 to 4,000 meters per minute.

* * * * *